US006371781B1

(12) United States Patent
Jones et al.

(10) Patent No.: US 6,371,781 B1
(45) Date of Patent: Apr. 16, 2002

(54) ZIF MEMORY MODULE ASSEMBLY

(75) Inventors: Dennis B. Jones, Orange; Andrew Cheng, Cerritos, both of CA (US)

(73) Assignee: Hon Hai Aprecision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/653,926

(22) Filed: Sep. 1, 2000

(51) Int. Cl.[7] ..... H01R 13/62
(52) U.S. Cl. ..... 439/260
(58) Field of Search ..... 439/259, 260, 439/635, 637, 263

(56) References Cited

U.S. PATENT DOCUMENTS 3,912,353 A * 10/1975 Kasuya et al. ..... 439/329
4,373,764 A * 2/1983 Ulrich ..... 439/327
4,553,803 A * 11/1985 Lapraik et al. ..... 439/260
5,391,089 A * 2/1995 Quickel et al. ..... 439/260
5,573,415 A * 11/1996 Fujitani et al. ..... 439/260
5,954,530 A * 9/1999 Ichimura ..... 439/260
6,106,337 A * 8/2000 Yu et al. ..... 439/637
6,132,224 A * 10/2000 Murakami et al. ..... 439/77
6,149,467 A * 11/2000 Choy ..... 439/637

* cited by examiner

*Primary Examiner*—Brian Sircus
*Assistant Examiner*—Thanh-Tam Le
(74) *Attorney, Agent, or Firm*—Wei Te Chung

(57) ABSTRACT

An enhanced memory module assembly comprises a memory module including a substrate with a plurality of conductive traces arranged in an edge thereof. A connector includes a first housing having a memory module receiving slot extending along a longitudinal direction thereof. The housing further defines a plurality of terminal cells with a plurality of first terminals assembled therein. Each terminal includes a first end extending into the elongate slot for electrically contacting with the conductive traces. A ZIF device is arranged between the memory module and includes a pair of actuator receiving slots located in the housing and in communicating with the terminal cells, and an actuator attached to the memory module. The actuator includes a pair of actuating plates extending into the actuator receiving slots thereby pushing the terminals in electrical contact with the conductive traces when the memory module is completely inserted therein.

3 Claims, 7 Drawing Sheets

ZIF MEMORY MODULE ASSEMBLY

FIELD OF THE INVENTION

The present invention relates to a memory module assembly, and more particularly to a zero-insertion-force (ZIF) memory module assembly in which the memory module can be easily inserted into a corresponding connector without initial contacting force therebetween.

DESCRIPTION OF THE PRIOR ART

Workstations and servers have been widely used in working area. In order to overcome a severe environment, electrical devices and components installed in the workstations and servers have to undergo severe test, typically a vibration test.

A connector for use with a memory module is generally referred to a DIMM (dual-in-line-memory-module) connector. A DIMM connector generally includes an elongate housing defining an elongate slot along the longitudinal direction. A plurality of terminals arranged in the elongate slot for electrically connecting with the memory module. The housing further includes a pair of tower each with an ejector pivotally assembled thereto. The tower further defines a guiding slot for easy insertion of the memory module into the slot. However, in order to easily insert the memory module into the slot, the guiding slot is dimensioned to smooth the insertion. As a result, the memory module is simply retained by the contacting ends of the terminals, connections between contacting ends and conductive traces of the memory module can be negatively influenced under vibration. This situation becomes worse in high speed signal transmission.

U.S. Pat. Nos. 5,364,282; 5,429,523; 5,603,625; 5,775,925 and 5,928,015 issued to Tondreault address different solutions for the above-mentioned issue. The improvement is that ejectors which pivotally assembled to the towers are each provided with a pair of side panels thereby defining a slot therebetween. An edge of the memory module can be received in the slot thereby partially retaining an additional portion of the memory module to overcome the vibration. It seems to solve the problem at the present stage. However, since the signal transmission speed becomes higher and higher, this kind of arrangement is not longer meets the requirements of workstations and server.

In addition, the ejector is pivotally assembled to the tower through a pin and socket arrangement. Since both the ejector and tower are made from plastic material, wearing off is inevitably after a period of usage. Gradually, the retaining force exerted by the ejector is no longer good enough to securely retain the memory module.

Aside that the memory module shall be securely retained within the connector, another problem is the conductive traces arranged along the edge of the memory module. The conductive trace is a copper foil which is plated on a resin sheet. During insertion of the memory module into the connector, contacting ends of the connector will impose a wiping force to the copper foil. The copper foil can be easily peeled off if the insertion of the memory module is not carefully taken. As a result, this is another problem to be addressed.

SUMMARY OF THE INVENTION

It is an objective of this invention to provide a ZIF memory module assembly in which the memory module can be easily inserted into a corresponding connector without initial contacting force therebetween.

In order to achieve the objective set forth, an enhanced memory module assembly in accordance with the present invention comprises a memory module including a substrate with a plurality of conductive traces arranged in an edge thereof. A connector includes a first housing having a memory module receiving slot extending along a longitudinal direction thereof. The housing further defines a plurality of terminal cells with a plurality of first terminals assembled therein. Each terminal includes a first end extending into the elongate slot for electrically contacting with the conductive traces. A ZIF device is arranged between the memory module and includes a pair of actuator receiving slots located in the housing and in communicating with the terminal cells, and an actuator attached to the memory module. The actuator includes a pair of actuating plates extending into the actuator receiving slots thereby pushing the terminals in electrical contact with the conductive traces when the memory module is completely inserted therein.

According to one aspect of the present invention, a wall of the actuator receiving slot includes a projection extending therefrom, while the actuating plate includes a cantilevered bump corresponding the projection of the actuator receiving slot. The bump of the actuating plate slides over the projection when the actuator is located in the second position.

According to another aspect of the invention, an ejector is incorporated in the housing and adapted to disengage the memory module from the connector.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
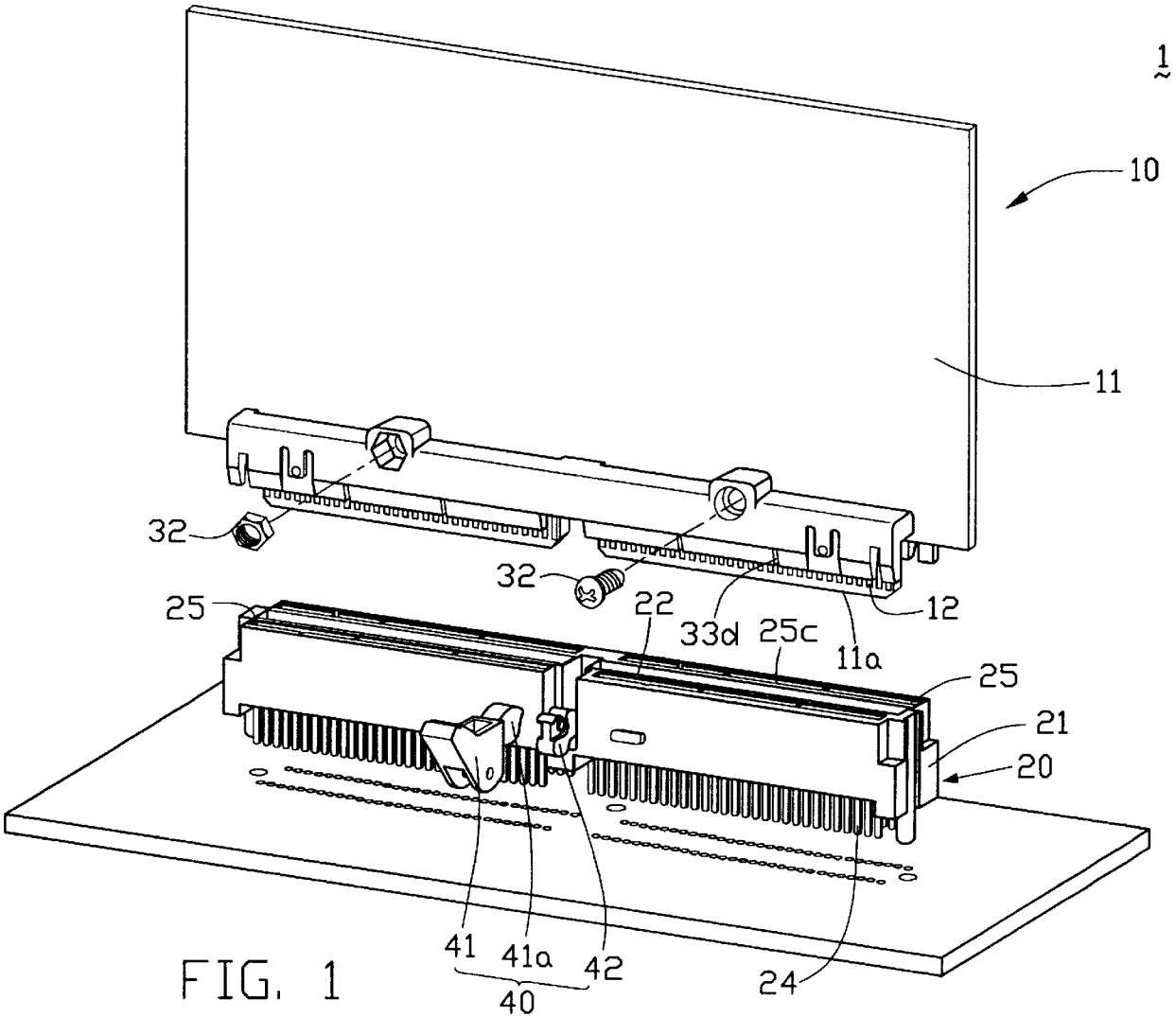
FIG. 1 is a perspective view of a ZIF memory module assembly.
Figure 2:
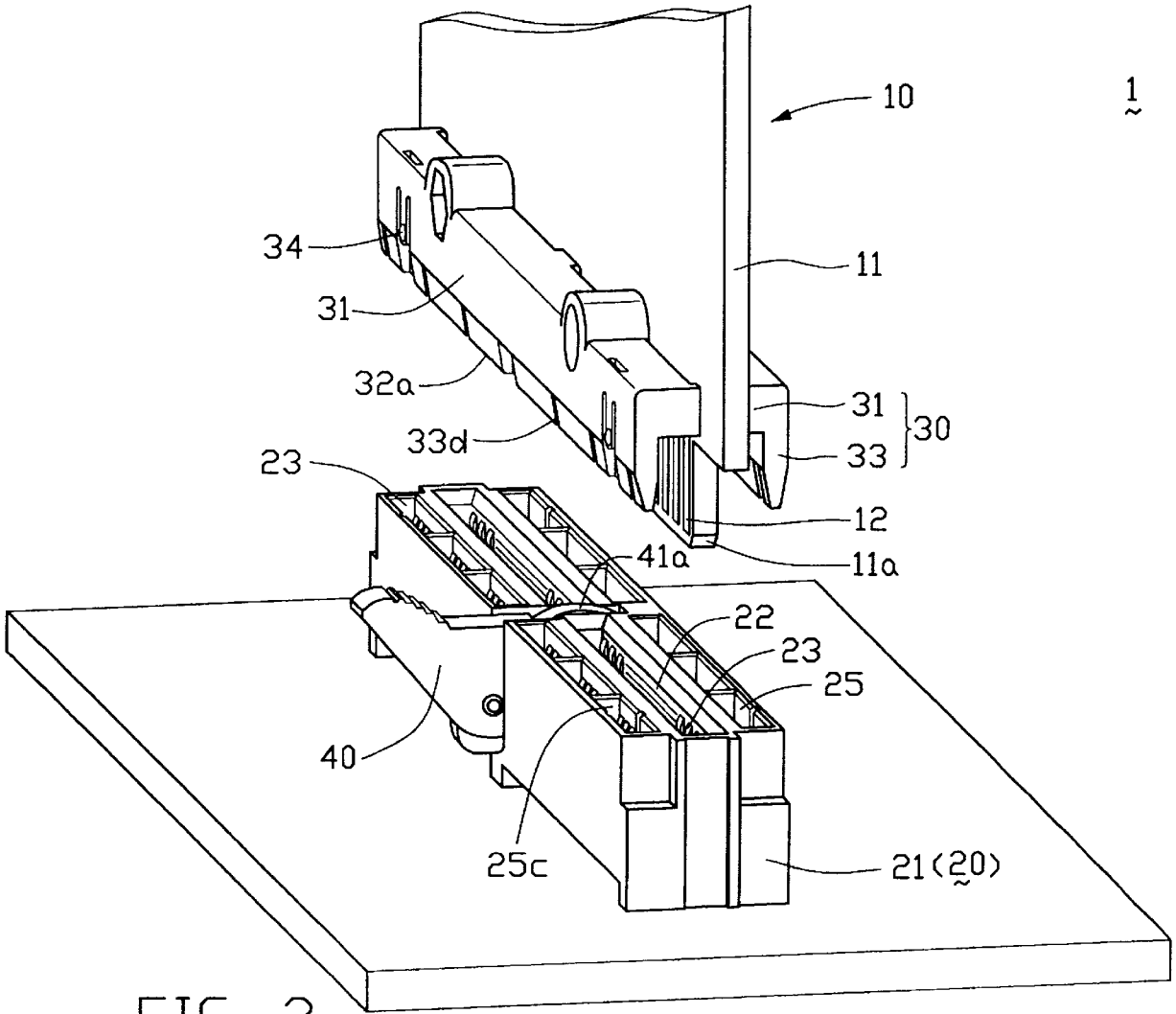
FIG. 2 is a perspective view of FIG. 1 from another angle.
Figure 3:
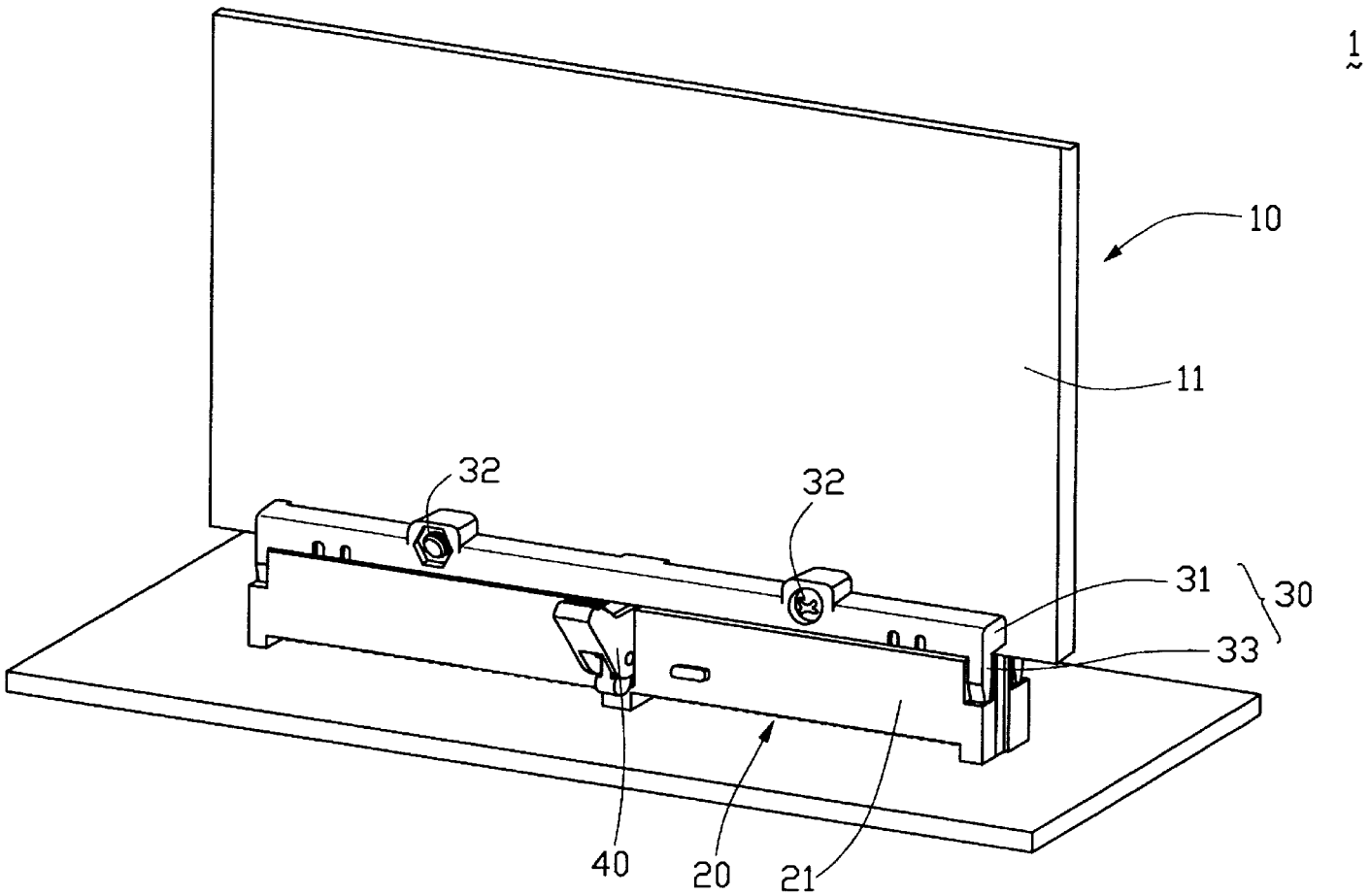
FIG. 3 is an assembled view of FIG. 1.
Figure 4:
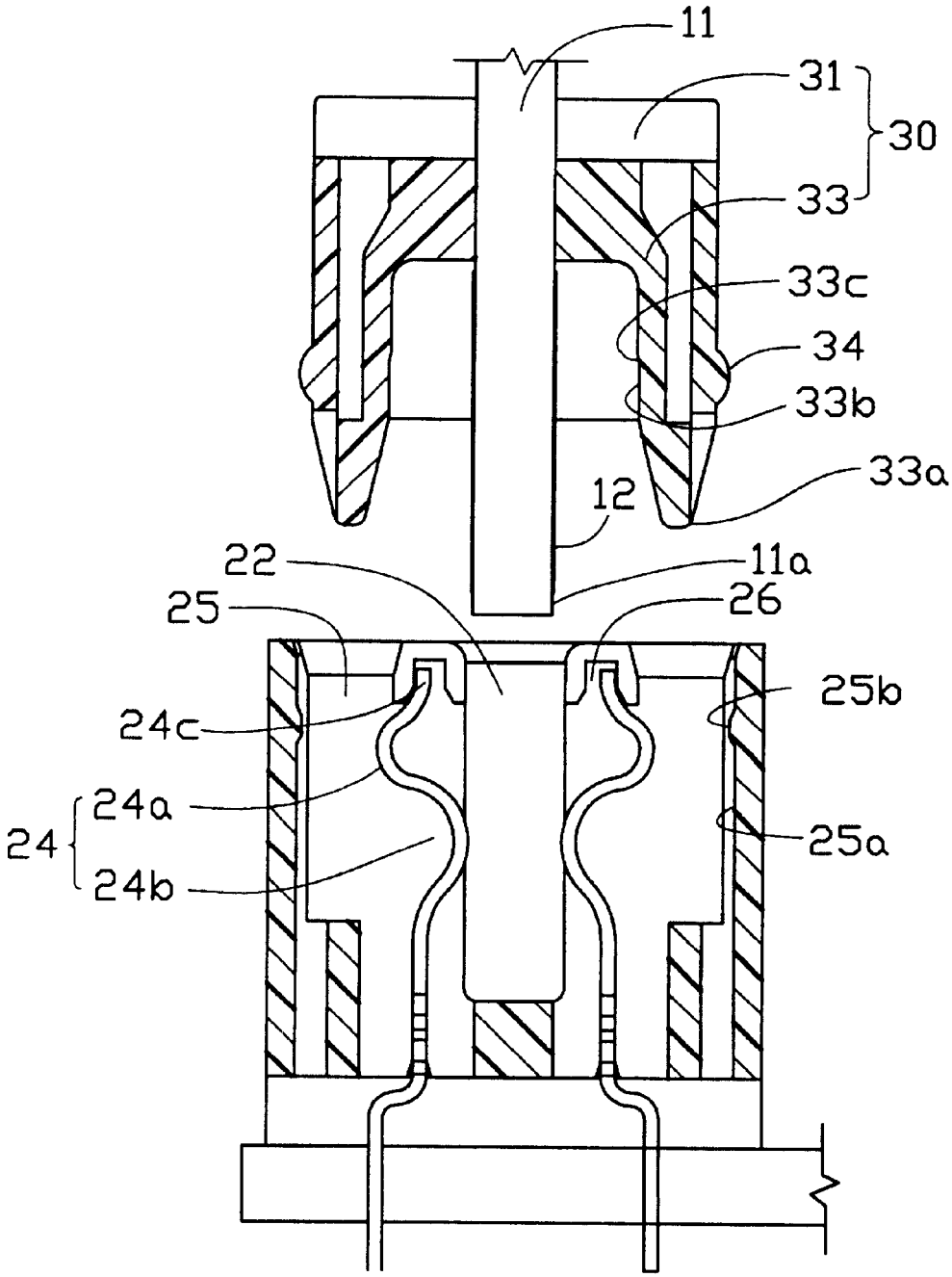
FIG. 4 is a cross sectional view before the memory module is inserted into the connector.

Referring to FIGS. 1 through 7, an enhanced memory module assembly 1 in accordance with the present invention comprises a memory module 10 including a substrate 11 with a plurality of conductive traces 12 arranged in an edge 11*a* thereof. A connector 20 includes a first housing 21 having a memory module receiving slot 22 extending along a longitudinal direction thereof. The housing 21 further defines a plurality of terminal cells 23 with a plurality of first terminals 24 assembled therein. Each terminal 24 includes a first end 24*a* extending into the elongate slot 22 for electrically contacting with the conductive traces 12. The housing 21 further defines a pair of actuator receiving slots 25 arranged in parallel to the terminal cells 23. According to the preferred embodiment, the memory module receiving slot 22 is arranged between the actuator receiving slots 25.

A pair of actuators 30 each including a base 31 is attached to the substrate 11 from opposite surfaces thereof and adjacent to the conductive traces 12. Each base 31 includes a through hole 31*a* aligned with a corresponding hole 13 in the substrate 11. A screw and nut arrangement 32 is provided to securely attach the actuators 30 to the memory module 11.

The actuator 30 includes a pair of actuating plates 33 extending into the actuator receiving slots 25 thereby pushing the terminals 24 in electrical contact with the conductive traces 12 when the memory module 10 is completely inserted therein.

In order to increase the rigidity of the actuator receiving slots 25, each is enforced by a partitioning wall 25*c* while the actuating plate is provided with slit 33*d* corresponding to those slits 25*c*.

Referring to FIGS. 4 to 7, it can be readily appreciated that the terminal 24 includes a biasing portion 24*a* and a contact portion 24*b* which are arranged in two sides of a longitudinal axis of the terminal 24. The biasing portion 24*a* extends into the actuator receiving slot 25 before the actuating plate 33 is inserted thereto. As a matter of fact, a free end 24*c* of the terminal 24 is free to move in a recess 26. The contacting portion 24*b* is kept in the terminal cell 23 before the actuating plate 33 is inserted therein. When the actuating plate 33 is inserted, the contacting portion 24*b* will be pushed into the memory module receiving slot 22 thereby establishing an electrically contact with the corresponding conductive trace 12 of the inserted memory module 10.

Figure 5:
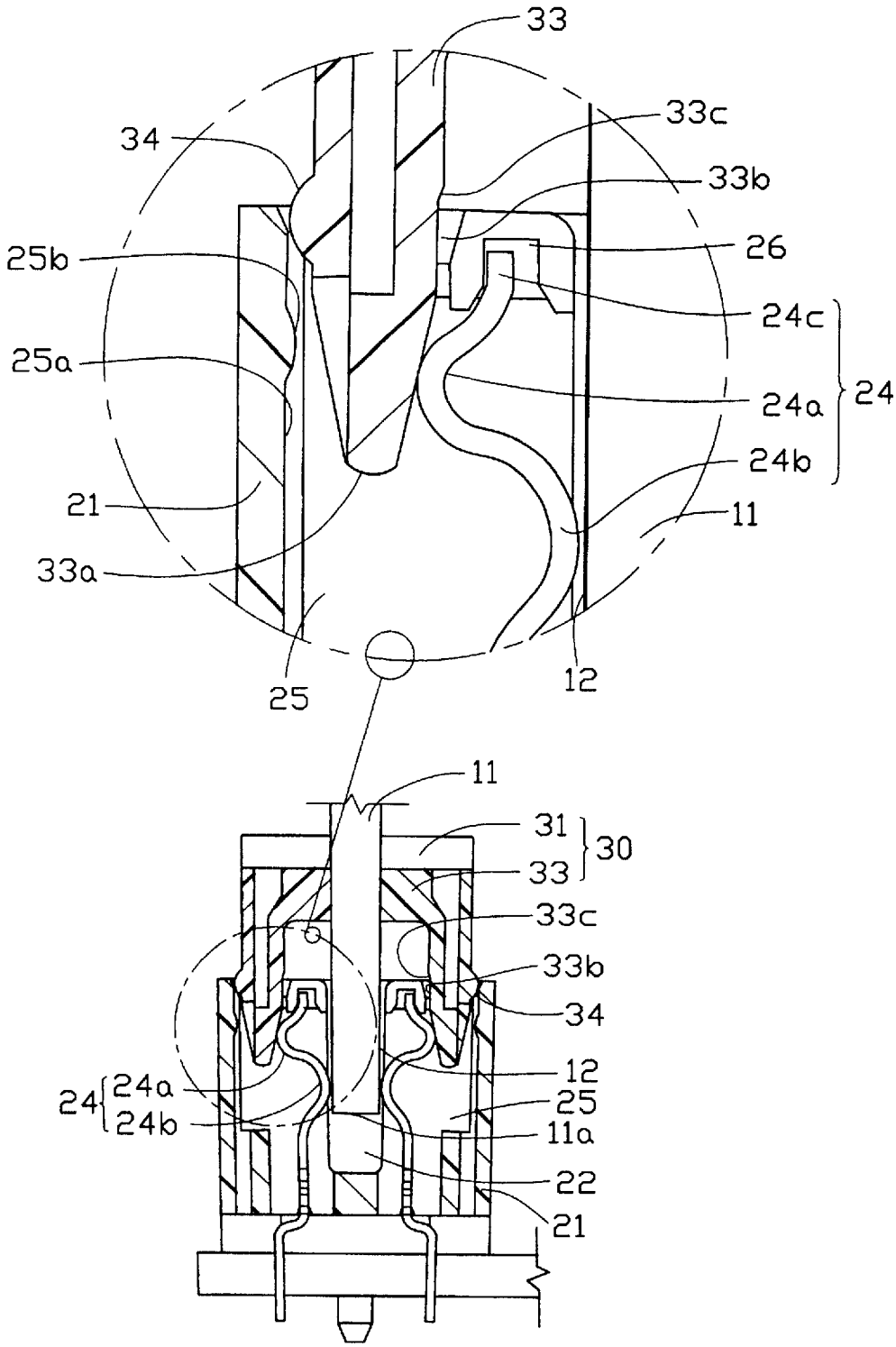
FIG. 5 is a cross sectional view showing that the memory module is in an initial position in which conductive traces on an edge of the memory module is in contact with terminals located in the connector.
Figure 6:
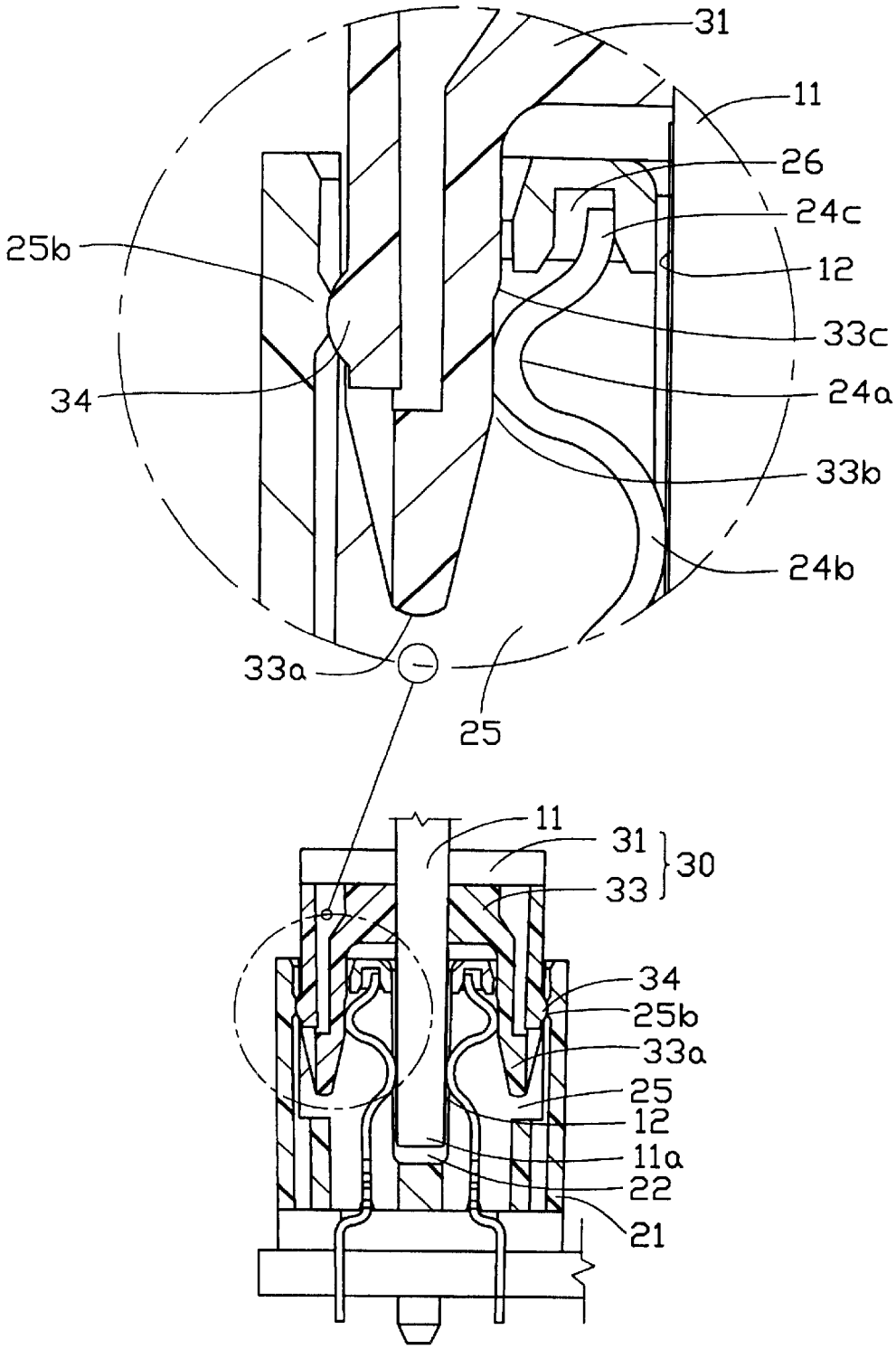
FIG. 6 is a cross sectional view showing that a bump of an actuating plate of an actuator abuts against a projection located in a wall of an actuating receiving slot.
Figure 7:
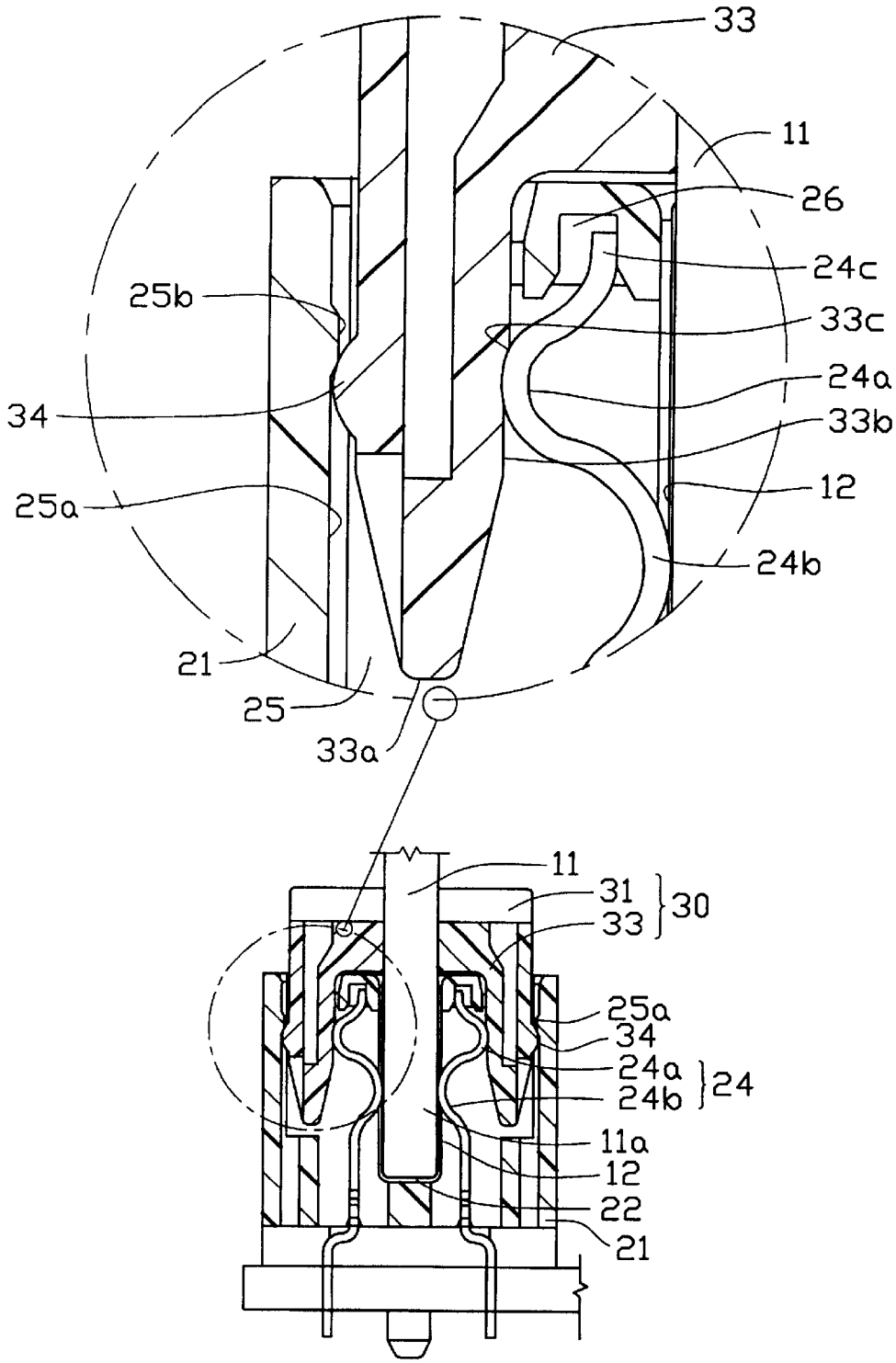
FIG. 7 is a cross sectional view showing that the bump slides over the projection while the terminals are pushed toward the conductive traces.

In order to provide an "positive" feeling to indicate the user that the memory module 10 has reached to a final position, the actuator 30 is provided with a pair of bumps 34 cantilevered from the base 31, while a inner wall 25*a* of the actuator receiving slot 25 is provided with a pair of projections 25*b* corresponding to the bumps 34. As a result, after the bumps 34 slide over the projections 25*b*, the actuating plate 33 reaches to its final position in which the biasing portion 24*a* is pushed toward the memory module 10 and the contacting portion 24*b* is in contact with the conductive traces 12 accordingly. FIGS. 5, 6 and 7 clearly describe the details between the bumps 34 and the projections 25*b*. Furthermore, the user can accurately "feel" the connection has been completed.

In addition, the actuating plate 33 includes a taper end 33*a* which apparently reduces the initial contact/wiping force between the contact portion 24*b* and the conductive traces 12. As clearly shown in FIG. 5, when the conductive traces 12 are inserted into the memory module receiving slot 22, the biasing portion 24*a* is not in contact with the taper end 33*a*, i.e. the position of the biasing portion 24*a* is remained unchanged. As a result, the contacting portions 24*b* exert zero normal force to the conductive traces 12.

While the memory module 10 keeps moving down, the taper ends 33*a* start to pushing the biasing portion 24*a* toward each other such that the contacting portion 24*b* start to contact with the conductive traces 12. When the contacting portions 24*a* are in contact with actuating portions 33*b* defined in an inner wall of the actuating plate 33, the contacting portions 24*b* of the terminals 24 are completely in contact with the conductive traces 12.

On the other hand, the actuating portion 33*b* further includes a step 33*c* which pushes the biasing portion 24*a* downward and toward the conductive traces 12. Since this step 33*c* works only after the bump 34 slides over the projections 25*b*, the normal force between the contact portions 24*b* and the conductive traces 12 is further enhanced.

On the other hand, because of the design of the taper end 33*a* of the actuating plate 33, and the arrangement of the bumps 34 and projections 25*b*, the wiping between the contact portions 24*b* and the conductive traces 12 is amazingly reduced to the length of the projection 35*b* and which is considerably smaller as compared to the prior art. As clearly shown in FIG. 4, the prior wiping distance between the contact portions 24*b* and the conductive traces 12 is A, while in the instant invention, the wiping distance is B which is considerably smaller than A.

In order to disengage the inserted memory module 10 from the connector 20, ejecting means 40 is arranged therebetween to facilitate the disengagement. According to a preferred embodiment, the ejecting means 40 includes an ejecting lever 41 pivotally supported on the housing 21 by a fulcrum 42 integrally formed thereof. The housing 21 defines a groove 27 in which a cam portion 41 a extends therein. When the ejecting lever 41 is in disabled position, the cam portion 41 a is retrieved in the groove 27, i.e. the cam portion 41*a* is within the groove 27. While then the ejecting lever 41 is actuated, the cam portion 41*a* will extend outward from the groove 27 thereby abutting a portion of the actuating plate 33. Consequently, the inserted memory module 10 can be disengaged from the connector 20.

As described above, the wiping distance of the present invention between the contact portions 24*b* and the conductive traces 12 is B. As a result, the displacement of the cam portion 41*a* can be selected to be a little more than that wiping distance B. As long as the bumps 34 are disengaged from the projections 25*b*, the memory module 10 can be easily taken out since the contacting portions 24*b* exert no normal force to the conductive traces 12. By this arrangement, the stroke of the cam portion 41*a* can be shortened and the configuration of the ejecting means 40 is also simplified.

While in the present invention, the ejecting means 40 is arranged such that it is perpendicular to a longitudinal axis of the housing 21. However, other modification can be also selected such that the ejecting means is parallel to the longitudinal axis of the housing 21.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An enhanced memory module assembly comprising:

a memory module including a substrate with a plurality of conductive traces arranged in an edge thereof;

a connector including a first housing having a memory module receiving slot extending along a longitudinal direction thereof, said housing further defining a plurality of terminal cells with a plurality of first terminals assembled therein, each terminal including a contacting portion extending into said elongate slot for electrically contacting with said conductive traces, and a biasing portion; and ejecting means arranged beside said housing and adapted to disengage said inserted memory module with said connector from a portion other than ends thereof; wherein said ejecting means includes a lever pivotally arranged in perpendicular to a longitudinal axis of said housing.

2. The enhanced memory module assembly as recited in claim 1, wherein said lever includes a cam portion extending into a groove in said housing.

3. An enhanced memory module assembly comprising:

a memory module including a substrate with a plurality of conductive traces arranged in an edge thereof;

a connector including a first housing having a memory module receiving slot extending along a longitudinal direction thereof, said housing further defining a plurality of terminal cells with a plurality of first terminals assembled therein, each terminal including a contacting portion extending into said elongate slot for electrically contacting with said conductive traces, and a biasing portion;

ZIF (zero insertion force) means arranged between said memory module and including a pair of actuator receiving slots located in said housing and in communicating with said terminal cells, and an actuator attached to said memory module and having a pair of actuating plates extending into said actuator receiving slots, each actuator receiving slot including a projection extending therefrom, each actuating plate including a bump corresponding to said projection of said actuator receiving slot, an inner wall of each actuating plate defining a step abutting biasing portions of said terminals when said bumps slide over said projections; and ejecting means arranged in said assembly and adapted to disengage said inserted memory module with said connector from a portion other than ends thereof, wherein said ejecting means includes a lever pivotally arranged in perpendicular to a longitudinal axis of said housing.

* * * * *